US006636610B1

(12) United States Patent
Betts

(10) Patent No.: US 6,636,610 B1
(45) Date of Patent: Oct. 21, 2003

(54) LOUDSPEAKER SYSTEMS

(75) Inventor: Robert W. Betts, Shelton, CT (US)

(73) Assignee: Sonic Systems, Inc., Stratford, CT (US)

( * ) Notice: Subject to any disclaimer, the term of this patent is extended or adjusted under 35 U.S.C. 154(b) by 444 days.

(21) Appl. No.: 09/692,092

(22) Filed: Oct. 19, 2000

(51) Int. Cl.[7] ..... H04R 25/00

(52) U.S. Cl. ..... 381/345; 381/352; 381/160; 181/153

(58) Field of Search ..... 381/345, 346, 381/348, 349, 352, 353, 354, 160; 181/153, 155, 156, 199

(56) References Cited

U.S. PATENT DOCUMENTS 4,063,387 A * 12/1977 Mitchell ..... 181/155
4,949,386 A * 8/1990 Hill ..... 381/349
5,886,304 A * 3/1999 Schlenzig et al. ..... 181/155

* cited by examiner

*Primary Examiner*—Huyen Le
(74) *Attorney, Agent, or Firm*—Melvin I. Stoltz

(57) ABSTRACT

By providing an enclosure having an acoustically optimum size and an effective or virtual air volume for optimum performance, a loudspeaker system is realized which is able to faithfully reproduce desired input signals, particularly, lower frequencies or bass sounds, in a seemingly small or undersized enclosure. In addition, the loudspeaker system of the present invention eliminates the distortion components found in prior art systems. Preferably, the loudspeaker enclosure of the present invention is cylindrical in cross-section, comprises the loudspeaker or driver mounted at one end of the cylinder, and an inwardly extending hemispherical baffle sealingly mounted to the opposed end of the cylindrical enclosure. In addition, a plurality of holes or vents are formed in the rear baffle.

8 Claims, 2 Drawing Sheets

LOUDSPEAKER SYSTEMS

BACKGROUND ART

Figure 1:
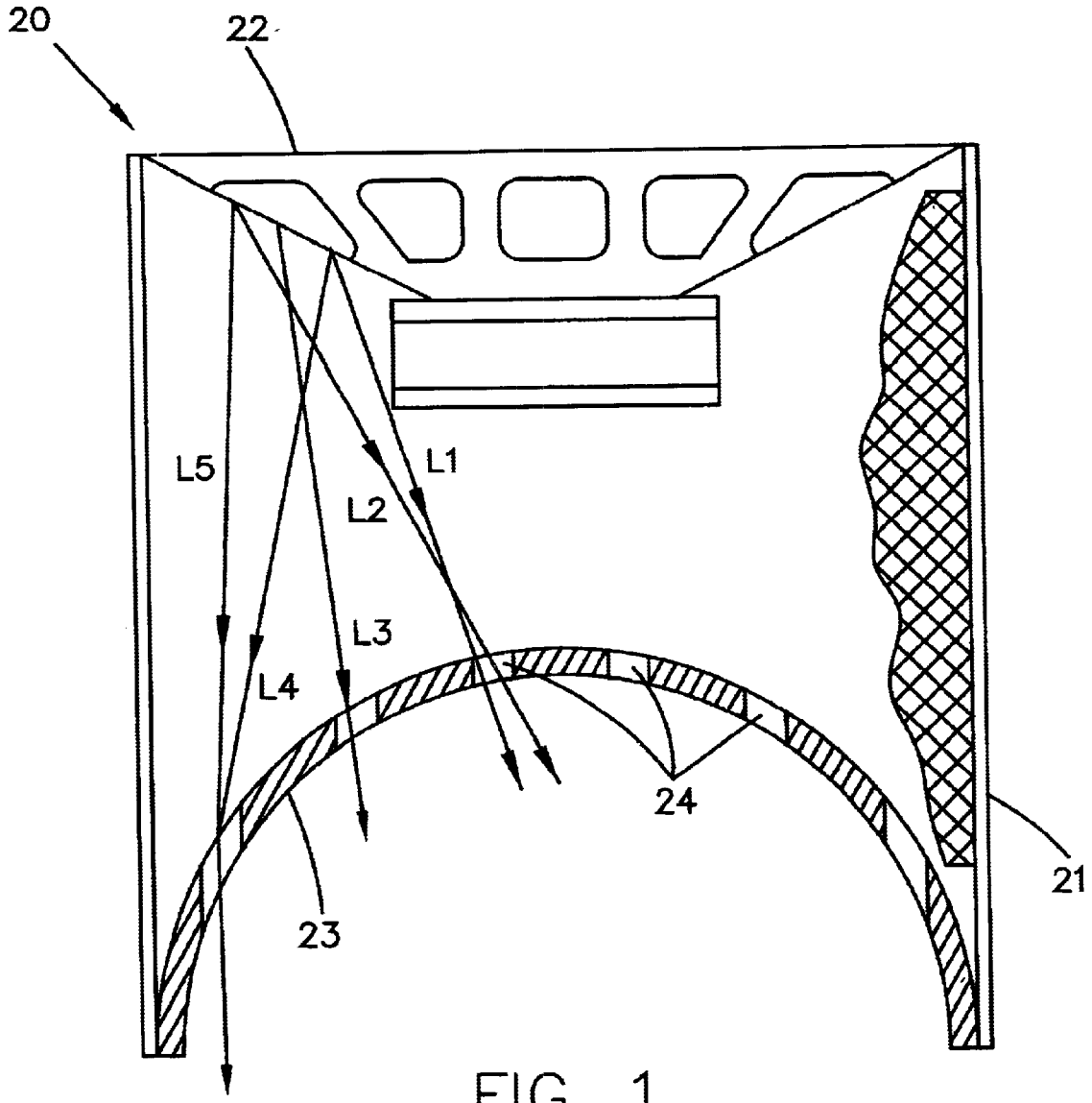

Speaker systems are widely used both commercially and personally for projecting or reproducing various sounds, principally music and voice. In the field of high fidelity music reproduction, substantial effort has been expended in an attempt to provide optimum sound reproduction. In particular, the most difficult area is the reproduction of lower frequencies or bass sounds, with bass sound reproduction in small or undersized loudspeaker enclosures being the most difficult.

In an attempt to satisfy this need, many methods and systems have been developed seeking to provide extended or enhanced bass response, using both single and multiple drivers. The prior art methods systems and constructions include tuned parts, ducted parts, vented ports, bass reflex, labyrinth, horn, folded horn, corner reflection, acoustic suspension, air suspension, asymmetric signal generation, high compliance and low frequency drivers, and electronic bass boosters. Regardless of this substantial effort, the desired goal has remained unsatisfied.

Each of these prior art attempts rely upon a tuned, undamped resonant acoustical path, acoustical circuit, or intrinsic enclosure resonances to enhance the loudspeaker system's efficiency at the desired bass frequencies or frequency bands. However, these systems suffer from several common shortcomings.

Firstly, all known resonant tuning methods create an acoustical path of little or no resistance or acoustical impedance, which in turn, causes a very high acoustical efficiency for the frequencies or frequency bands of concern. This results in a lack of critical acoustical damping of the reproduced signal. Critical damping is commonly known as "unity damping".

Any value for damping, in a loudspeaker system, which is significantly more or less than unity is not suitable for the accurate reproduction of sound. Systems utilizing the prior art types of tuning will usually generate the required amount of bass frequency output. However, the quality of the acoustic output will have little or no relationship to the original input signal. They alter or "color" the signal to effect an artificial bass sound.

Another problem usually encountered with these prior art systems, typically due to the insufficient damping, is a condition called "ringing". Ringing is typified by the condition where the diaphragm of a loudspeaker or driver is not under control of the applied signal. As a result, abnormally high levels of distortion are produced, along with the generation of false or "colored" acoustical signals when compared to the original input signal.

Basically, ringing is produced by the excitation of the driver's moving mass, the speaker cone and/or voice coil and suspension, by the electronic signal that causes the mass to oscillate at a fundamental period which is not necessarily related to the original input signal. The fundamental period, frequency or musical note, is an acousto-mechanical product of the total moving mass, the stiffness of the air within the enclosure, the compliance of the driver's suspension, the length of the resonant path and other associated variables. A ringing condition is frequency selective, and therefore, not faithful to the original input signal. A ringing system can usually be excited into the ringing mode by a frequency totally unrelated, but close to the ringing or resonant frequency.

The problems typically found in tuned, resonant, undamped and ringing prone systems are very high levels of acoustical distortions. Typical types of acoustical distortion produced by these systems are harmonic distortion or total harmonic distortion, intermodulation distortion, and phase distortion.

Harmonic distortion or total harmonic distortion is the type of distortion which is generated in several various ways. However, in the systems detailed herein, harmonic distortion is classified by its incidental composition—second order (first harmonic), third order (second harmonic), fourth order (third harmonic). For example, a 100 Hz fundamental signal generates a 200, 300, and 400 Hz frequency. Sub-harmonics may also occur at half, one-third, one-quarter, etc. of this fundamental note. Under the condition of ringing in an undamped, resonant system, it is natural for the loudspeaker to produce these coincidental notes or frequencies.

Intermodulation distortion is more technically involved and consists of products totally unrelated or not incidental to the original frequency. Typically, intermodulation distortion is generated by the remodulation of one signal by another which in turn produces sum and difference frequencies. If, for example, the air pressure within a loudspeaker enclosure is at a very high level for one particular frequency as compared to a lower pressure at another frequency, the higher pressure condition will tend to modulate the lesser pressure condition thereby creating a sum product frequency and a difference frequency. These sum and difference notes do not exist in the original input signal, thus, they are unwanted distortions.

Finally, phase distortion is produced when highly resonant, undamped ringing occurs in the "time domain". Essentially, from the initial excitation, until the ringing subsides, a finite period of time passes. Since the ringing loudspeaker is producing sound long after the original input electrical signal is gone, the moving mass of the loudspeaker's driver continues to oscillate at a rate or period based on its own physical characteristics. This effect generally causes the ringing frequency to either increase or decrease in its fundamental period. Since the original input frequency was of a given period with its own specific phase relationships, any variation from the original will, of consequence, create different, unrelated phase components.

In addition, the products of total harmonic distortion and intermodulation distortion, either together or individually, will mix acoustically and/or electrically in multiplicities to create very complex, albeit unwanted, by-products. Although this condition is most easily identified and analyzed as additional total harmonic distortion and intermodulation distortion, subsequent additional phase distortion will always result.

SUMMARY OF THE INVENTION

By employing the present invention, all of the difficulties and drawbacks of prior art loudspeaker constructions are overcome, and a loudspeaker system is realized which is able to faithfully reproduce desired input signals, particularly, lower frequencies or bass sounds. Furthermore, this result is achieved in a seemingly small or undersized enclosure which is able to exhibit a linear loading coefficient and unity coupling factor for the wavelengths or frequencies of concern.

In accordance with the present invention, the enclosure is physically smaller than seemingly required for providing actual enclosures air volume for optimum performance of the loudspeaker. However, using the present invention, the enclosure has an acoustically optimum size, providing an effective or virtual air volume for optimum performance. In addition, the loudspeaker of the present invention eliminates the distortion components found in prior art systems.

As is well known, the ideal condition for the essentially distortion-free driver enclosure is the "half-space" baffle. In a half-space baffle, the shortest dimension is greater than a half-wavelength of the lowest frequency that the driver is capable of producing. As a result, the front wave is incapable of interacting with the back wave.

In order to achieve this result, the hypothetical half-space baffle must be infinite in length and width. Since this is physically impossible, reasonable compromises must be made.

Any loudspeaker enclosure that isolates, then dampens, and finally absorbs or otherwise dissipates the back waves of a driver from the front waves and is of suitable size to prevent reactive air pressure levels or otherwise impede the operation of the driver, is called an "infinite baffle". Under these ideal conditions, the enclosure is infinite in volume, as far as the driver is concerned. However, since a bass driver of a given size and of any given electrical-acoustical-mechanical characteristics require an enclosure of a specific volume for optimum performance, anything less in internal enclosure volume yields less than optimal results.

In attempting to achieve the ideal enclosure construction, the prior art enclosures are generally constructed with opposing surfaces that are parallel, flat, and dimensionally constant at any perpendicular position; a rectangular box. However, by totally deviating from these standard configurations, a new, unique, highly effective speaker enclosure is realized.

In particular, the loudspeaker enclosure of the present invention is cylindrical in cross-section, and comprises the loudspeaker or driver mounted at one end of the cylinder.

In addition, the opposed or rear end of the cylindrical enclosure is sealed with a hemispherical baffle which is positioned to have a concave shape when viewed from the outside. As a result, internally, the baffle forms a convex shape to provide a rigid surface for the acoustical pressures generated by the speaker's moving diaphragm or cone.

In addition, in accordance with the present invention, a plurality of holes or vents are formed in the rear baffle. These vents are constructed with a diameter and position which effectively forms a plurality of acoustical paths which are non-coincidental in wavelength dimension along the axial dimension of the enclosure.

As a result, the internal volume of air within the enclosure of the present invention will not be resonant at any one specific frequency. This causes the enclosure to be effectively or virtually acoustically infinite in volume.

The invention accordingly comprises the features of construction, combination of elements, and arrangement of parts which will be exemplified in the construction hereinafter set forth, and the scope of the invention will be indicated in the claims.

THE DRAWINGS

Figure 2:
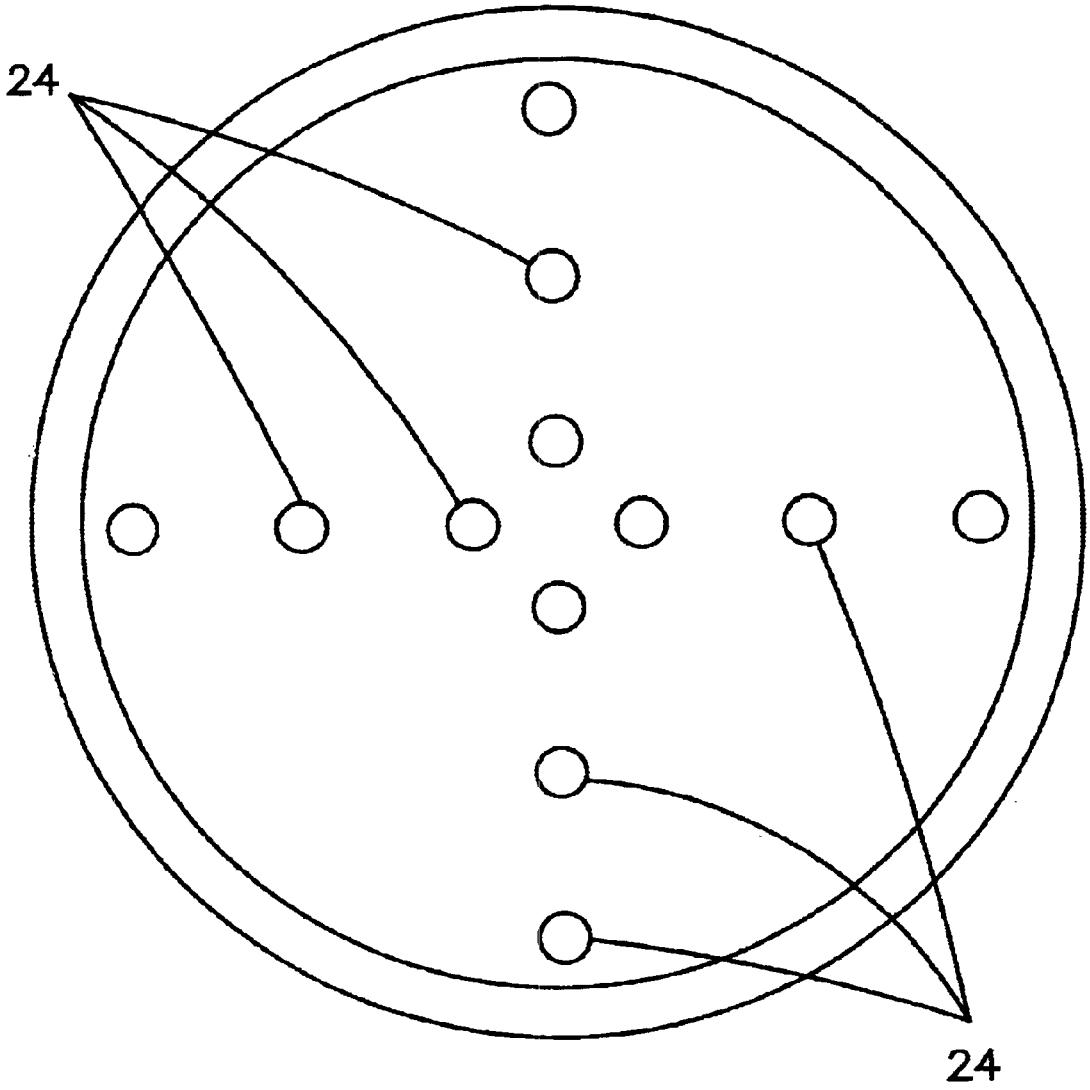

For a fuller understanding of the nature and objects of the invention, reference should be had to the following detailed description taken in connection with the accompanying drawings, in which:

FIG. 1 is a cross-sectioned side elevation view of a loudspeaker system manufactured in accordance with a present invention; and FIG. 2 is a rear view of the loudspeaker system of FIG. 1.

DETAILED DISCLOSURE

By referring to FIGS. 1 and 2, along with the following detailed discussion, the overall construction and operation of the present invention can best be understood. As will become evident to one of ordinary skill in the art, FIGS. 1 and 2 depict the preferred embodiment of the present invention. However, alternate constructions and variations of the construction shown can be made without departing from the scope of this invention. Consequently, it is to be understood that the construction shown in FIGS. 1 and 2 is provided for exemplary purposes only and is not intended to limit the present invention thereto.

As shown in FIG. 1, loudspeaker system 20 of the present invention comprises a cylindrically shaped enclosure 21, a speaker or driver 22 mounted at one end of the enclosure 21, and a hemispherically shaped baffle 23 mounted at the opposed end of enclosure 21. As depicted, hemispherical baffle 23 is mounted to enclosure 21 with the concave forming surface thereof viewable from outside of enclosure 21. As a result, baffle 23 establishes a convex surface within enclosure 21, which surface is in juxtaposed, spaced, cooperating relationship with driver 22. By employing this construction, the convex surface of baffle 23 receives the acoustical pressures generated by the moving diaphragm or cone of speaker/driver 22.

In order to complete the present invention and provide the unique construction attainable therewith, a plurality of holes or vents 24 are formed in baffle 23. By constructing vents 24 with the proper diameter and by placing vents 24 in the optimum positions, any acoustical path between any one vent or set and any other vent or set of vents in non-coincidental in wavelength dimension along the axial dimension of the enclosure. In the preferred embodiment, the axes of the holes or vents 24 are aligned in at least three circular paths. This is diagrammatically depicted in FIG. 1, where wavelengths L1, L2, L3, L4 and L5 are shown, with each wavelength being non-coincidental, such as not evenly divisible, with each other.

As is well known, any given volume of air will be naturally resonant at some fundamental frequency. However, by employing the present invention, the net acoustical result that is attained from this linear loading/unity coupling design geometry is an internal volume of the air within the enclosure which will not be resonant at any one specific frequency. Instead, due to the multiple and variable path lengths between the hemispherical baffle and the diaphragm of speaker driver 22, a series of minor cavitational resonances occur.

As a result, enclosure 21 is effectively or virtually infinite in volume. This effect is further defined by the fact that the pattern of vents 24, as a collective system, are essentially non-resonant, as opposed to the prior art designs, such as tuned ports, ducted ports, and base reflex systems.

Acoustical measurements made on the loudspeaker system of the present invention, designed for linear loading and unity coupling, indicate a minimal system fundamental resonance or natural resonance that is normally attributable to the volume of the air or air mass within the enclosure. In terms of damping, loading and coupling, the loudspeaker of the present invention performs essentially as though it is in a true infinite baffle enclosure, even though the actual enclosure is physically smaller than traditional design practices would dictate.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limited sense.

It is also to be understood that the following claims are intended to cover all of the generic and specific features of the invention herein described, and all statements of the scope of the invention which, as a matter of language, might be said to fall therebetween.

What is claimed is:

1. A loudspeaker system constructed for faithfully reproducing the desired input signals in a small or undersized enclosure, said system comprising:

A. a housing comprising an elongated, hollow, cylindrical shape, having a first portal zone formed at one end thereof and a second portal zone formed at the opposed end thereof;

B. at least one loudspeaker driver for generating sound energy in response to the activation thereof and mounted in said cylindrical housing in cooperating relationship with the first portal zone; and C. an arcuately curved baffle mounted to the second portal zone of the cylindrical housing in sealed interengagement therewith, with said arcuately curved baffle extending inwardly from the terminating end of said housing, thereby providing a rigid surface for the acoustical pressures generated by a diaphragm of the loudspeaker driver.

2. The loudspeaker system defined in claim 1, wherein said arcuately curved baffle is further defined as comprising a hemispherical shape.

3. The loudspeaker system defined in claim 2, wherein said arcuately curved baffle is further defined as comprising a plurality of holes or vents formed therein, effectively creating a plurality of separate and independent acoustical paths having non-coincidental wavelength dimensions along the axis of the housing.

4. The loudspeaker system defined in claim 3, wherein said holes or vents are further defined as being substantially circular in shape.

5. The loudspeaker system defined in claim 4, wherein the axis of each of said plurality of holes or vents are further defined as being parallel to the central axis of the housing.

6. The loudspeaker system defined in claim 5, wherein said plurality of holes or vents are essentially non-resonant.

7. The loudspeaker system defined in claim 5, wherein the axes of said plurality of holes or vents are further defined as being aligned in at least three circular paths.

8. The loudspeaker system defined in claim 7, wherein said circular paths are further defined as being co-axial with each other.

* * * * *